United States Patent [19]

Schwarz

[11] 4,362,322

[45] Dec. 7, 1982

[54] SKI STICK

[76] Inventor: Jochen Schwarz, 39 1/2 Post Bruckmuhl, Ginsham, Fed. Rep. of Germany

[21] Appl. No.: 165,186

[22] Filed: Jul. 1, 1980

[30] Foreign Application Priority Data

| | | | |
|---|---|---|---|
| Jul. 6, 1979 | [DE] | Fed. Rep. of Germany | 2927398 |
| Jan. 22, 1980 | [DE] | Fed. Rep. of Germany | 3002102 |
| Mar. 25, 1980 | [DE] | Fed. Rep. of Germany | 3011514 |

[51] Int. Cl.[3] ..... A63C 11/22

[52] U.S. Cl. ..... 280/821; 135/65; 135/82; 280/819

[58] Field of Search ..... 280/819, 820, 821, 822, 280/823, 816, 809; 135/65, 82, 83, 75, 76, 66

[56] References Cited

U.S. PATENT DOCUMENTS

| | | | |
|---|---|---|---|
| 4,061,347 | 12/1977 | Stern et al. | 280/821 |

FOREIGN PATENT DOCUMENTS

| | | | |
|---|---|---|---|
| 605168 | 11/1934 | Fed. Rep. of Germany | 280/823 |
| 1157982 | 11/1963 | Fed. Rep. of Germany | 280/819 |
| 2130838 | 1/1972 | Fed. Rep. of Germany | 280/823 |
| 2055597 | 5/1972 | Fed. Rep. of Germany | 280/819 |
| 2107075 | 6/1972 | Fed. Rep. of Germany | 280/821 |
| 2518425 | 11/1976 | Fed. Rep. of Germany | 280/821 |
| 2632201 | 1/1978 | Fed. Rep. of Germany | 280/823 |
| 2704751 | 8/1978 | Fed. Rep. of Germany | 280/821 |
| 2720754 | 12/1978 | Fed. Rep. of Germany | 280/819 |
| 7914662 | 8/1979 | Fed. Rep. of Germany | 280/821 |
| 2906918 | 8/1980 | Fed. Rep. of Germany | 280/821 |
| 2185924 | 4/1974 | France | 280/821 |
| 123014 | 10/1948 | Sweden | 280/823 |
| 216977 | 4/1942 | Switzerland | 280/819 |

*Primary Examiner*—Joseph F. Peters, Jr.
*Assistant Examiner*—Milton L. Smith

[57] ABSTRACT

A ski stick for use in particular in cross country skiing and having a sprung ski stick handle, which is fixed on the top end of a ski stick tube. The ski stick handle body is movable on the ski stick tube against a spring means arranged between the ski stick handle body and the ski stick tube in the direction of the ski stick tip.

The ski stick handle is designed in such a way that the spring means which are arranged on the top ski stick handle fixing means, are resiliently stretchable rubber or plastic cords which run through the ski stick handle body toward the ski stick tip and are joined to the ski stick handle body at the bottom end thereof.

13 Claims, 13 Drawing Figures

FIG.1
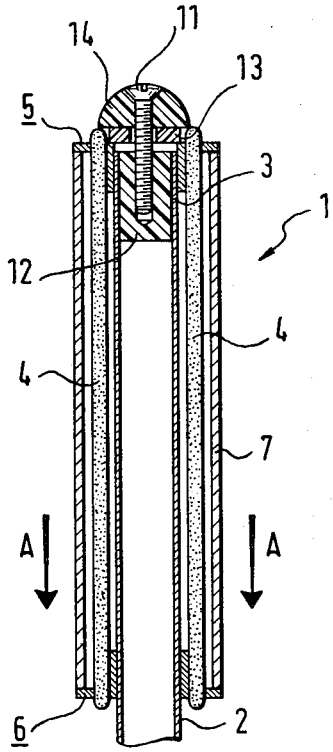
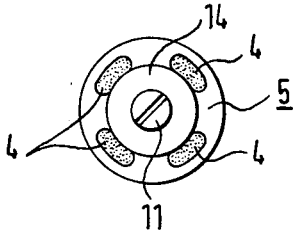
FIG.2
FIG.3
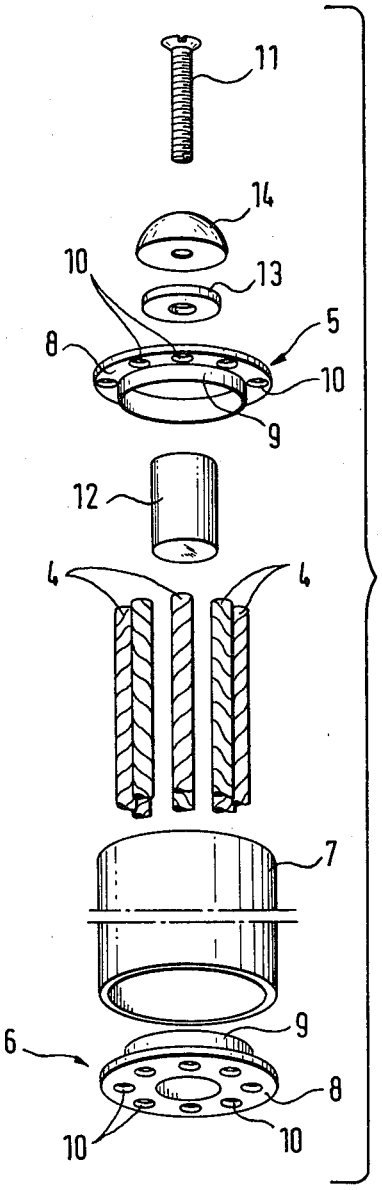

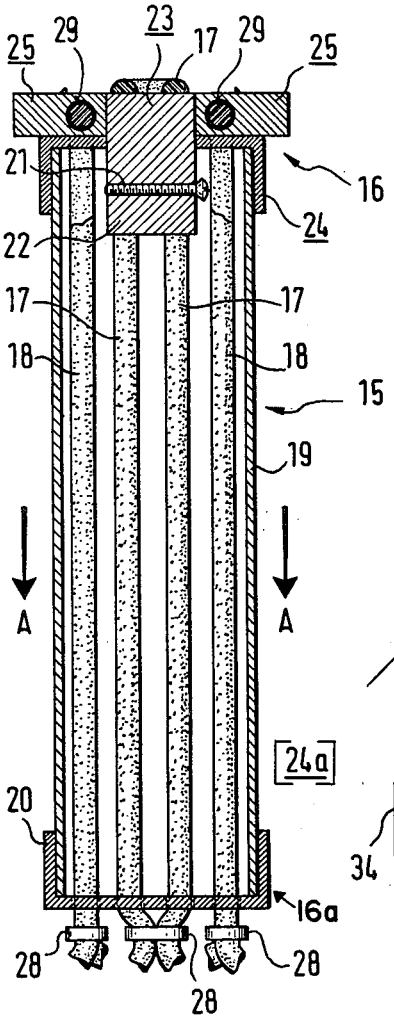
FIG. 4
FIG. 6
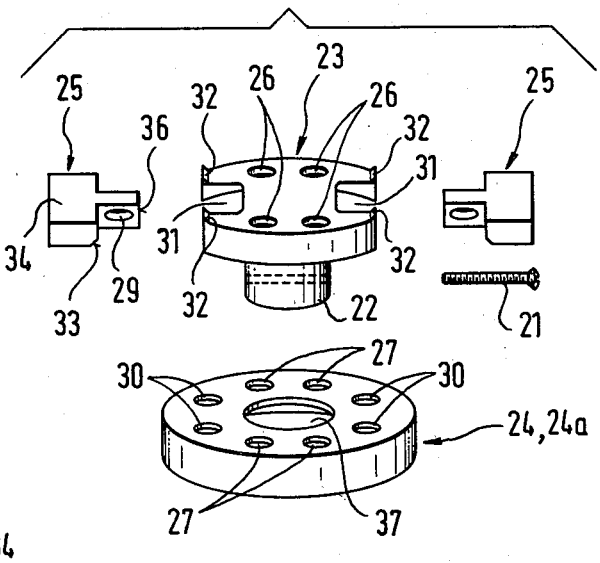
FIG. 7
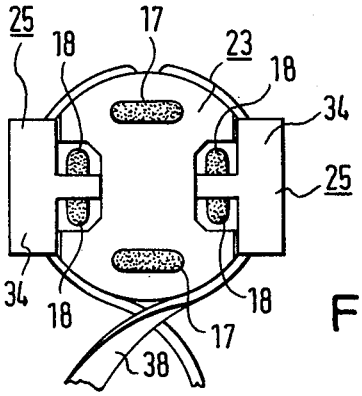
FIG. 5

FIG. 8
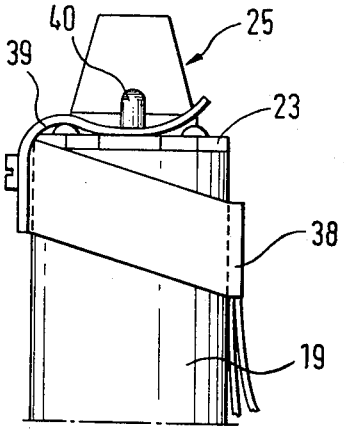
FIG. 9
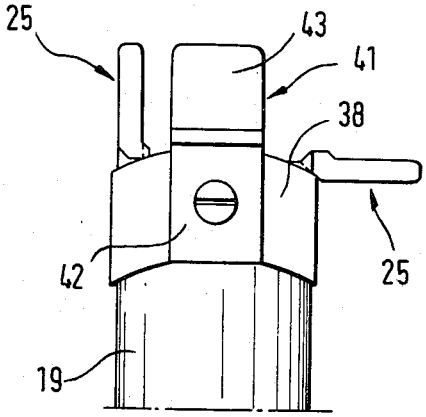
FIG. 11
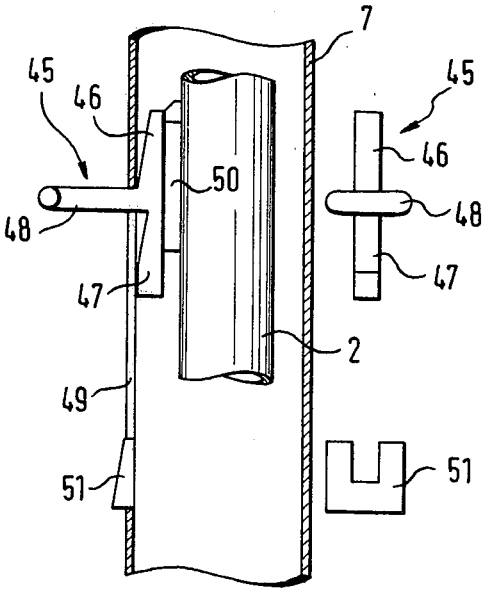
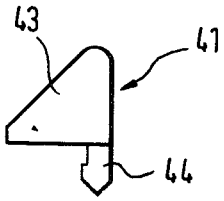
FIG. 10

SKI STICK

BACKGROUND OF THE INVENTION

The present invention relates to a ski stick having a sprung ski stick handle for use, in particular, in cross-country skiing. The handle which is fixed to the upper end of a ski stick tube has a handle body which is movable on the ski stick tube against a spring means arranged between the ski stick handle body and the ski stick tube toward the tip of the ski stick.

A number of sprung ski stick handles are known from the prior art. Thus, German Pat. No. 605168 describes a sprung ski stick handle in whose interior is provided a helical spring which rests, on the one hand, on the ski stick handle, and, on the other hand, on the ski stick body. The ski stick handle surrounds the upper end of the ski stick body and is resiliently movable in a telescopic manner along this upper end toward the tip of the ski stick against the spring force. A similar sprung ski stick handle also guided on the ski stick body and movable against the force of a coil spring in the direction toward the tip of the ski stick is also known from German Offenlegungsschrift No. 2107075. However, these two sprung ski stick handles have the disadvantage, in particular, that the ski stick is shortened during use of the stick and that, moreover, an additional force is needed to guide the ski stick since telescopic movement of the ski stick handle on the ski stick body or tube inevitably necessitates a certain clearance therebetween and therefore a tendency for these two parts to loosen relative to each other, which has to be compensated for in the telescopic displacement. Furthermore, German Offenlegungsschrift No. 2518425 describes a sprung ski stick handle which is made completely of an elastomeric material and is fixed by its upper end to the upper end of the ski stick tube, but whose body can stretch elastically in the longitudinal direction. However, such stretching does not necessarily mean a deformation of the ski stick handle while the handle being longer and thinner is unpleasant and irritating for the user.

Finally, a sprung ski stick handle of the type mentioned at the outset is known from German Auslegeschrift No. 1157982. This ski stick handle has a cavity in which is arranged a cylindrical helical compression spring which, with its lower end resting on the shaft of the ski stick, imparts to the handle or a sleeve of the handle a springiness acting in the longitudinal direction of the ski stick. The compression spring inserted in the cavity of the sleeve which is composed of elastic material, for example, rubber, is guided slidably on the ski stick shaft which runs through the inside of it. This ski stick handle also has the disadvantage already mentioned in conjunction with German Offenlegungsschrift No. 2518425 that it is deformed in an unpleasant way during use and that its lift is limited.

SUMMARY OF THE INVENTION

The present invention proposes a ski stick having a sprung handle of the type mentioned at the outset which can be moved against the force of a spring so that the energy stored during use of the ski stick can be employed for propulsion and which ensures flexible use of the stick without the ski stick handle body deforming in an unpleasant way during use and without shortening of the ski stick and the associated above-mentioned problems of guidance occurring, the lifting movement of the ski stick handle also being virtually unrestricted.

The sprung ski stick handle of the ski stick which is proposed by the present invention is distinguished in that the springiness at a top fastening of the ski stick handle is provided by resiliently stretchable rubber or plastic cords which run through the ski stick handle body toward the tip of the ski stick and are joined to the ski stick handle body at the bottom end thereof.

The above-mentioned advantages are achieved by means of such a design as that provided by the invention and the ski stick according to the invention has the additional advantages that the fitted spring members of rubber or plastic cord act in tension, that the resilience can be staggered in a simple manner, that the ski stick handle can be produced as a ready-to-use appliance and need not be specially adapted to each ski stick but can be fixed in a simple manner on any suitable ski stick tube, for example, by means of a screwdriver; that the spring parts, i.e. the rubber or plastic cords can be obtained easily and inexpensively, that the ski stick handle is light in weight, that the spring path is very long and the stored energy is thus high, and that a ski stick loop which follows the movement of the ski stick handle body can be fixed on to the ski stick handle body.

According to the present invention there is provided a ski stick comprising: a ski stick tube; a sprung ski stick handle having a handle body and top handle fixing means which is fixed on the top end of the ski stick tube and is displaceable with respect to the ski stick tube; and spring means arranged between the ski stick handle body and the ski stick tube which comprises resiliently stretchable cords which run through the ski stick handle body from the top handle fixing means toward the bottom end of the ski stick tube and are joined to the ski stick handle body at the bottom end thereof.

An embodiment of this sprung ski stick is distinguished in that the top ski stick handle fixing means is a component which is expandable inside the ski stick tube by means of a screw and by means of which a top fixing member lying on the top end of the ski stick tube with the rubber or plastic cord arranged on it and a recoil damper formed by an elastic disc and an elastic cone or dome body are connected.

The above mentioned recoil damper attenuates rebound of the ski stick handle body on the top fixing member, particularly if the tip of the ski stick slips on ice or a stone or, when using the ski stick handle with a ski roller stick (on asphalt or another ski roller track).

Another embodiment of the invention is distinguished in that only a few rubber or plastic cords are fixed by their top ends on the top fixing member which is stationarily arranged on the top end of the ski stick tube, whereas the top ends of the other rubber or plastic cords are fixed to separate anchor members which can be brought selectively into a first position in which they rest on the stationary top fixing member during a relative movement of the ski stick handle body and into a second position in which they are released by the stationary top fixing member and rest on a movable fixing member arranged at the top end of the ski stick handle body and are entrained by it.

The in and out anchoring of rubber and plastic cords which is possible in this embodiment is particularly important in cross-country skiing as different propulsion requirements arise, for example, during the use of double sticks and during diagonal travel. Whereas the cross country skier exerts a relatively great pressing force on the ski stick handle toward the tip of the ski stick, that is using the double sticks, so that maximum springiness is available for him to utilise this large pushing force as a propulsive force, the pushing force exerted on the ski stick handle toward the tip of the ski stick when using the stick is substantially less when adopting the diagonal stepping technique as most of the thrust is exerted by the legs in this technique because of the requirements of equilibrium and the rhythm, so that a proportion of the rubber or plastic cords can be made inoperative for adaptation to this smaller force.

A particularly practical embodiment of this ski stick handle whose springiness can be changed is distinguished in that the anchor members are substantially T-shaped, their longitudinal bars or stems, on which the top ends of the other rubber or plastic cords are fixed, each fitting, together with these cords into a recess which passes through the stationary top fixing member in the longitudinal direction of the ski stick. The cross bars of the T-shaped anchor members are thereby pivotal into a first position in which they are located above the stationary top fixing member and into a second position in which they are located laterally next to the stationary top fixing member. With an embodiment of this type, it is relatively simple to actuate the anchor members particularly if the anchor members or their cross bars project laterally beyond the periphery of the ski stick handle body and/or of the movable top fixing member in the second position. The design feature according to which the anchor members are substantially T-shaped also includes designs in which the longitudinal bar or stem of the T-shape is relatively short and/or in which the cross bar has a relatively large area and is also, for example, triangular, semi-circular or of similar form in shape, so that they can be used particularly well as an actuating element which is actuated, for example, by the user's thumb.

The sprung ski stick handle whose springiness can be changed is preferably also designed in such a way that the edge of the stationary top fixing member has a projection or elevation in addition to the recesses on one or both sides and which preferably runs obliquely toward the upper surface of the stationary top fixing member, a complementary bevel always being provided on the edges of the cross bars directly facing it in the first position of the anchor members. This prevents the anchor members from accidentally being released from their supporting engagement with the stationary top fixing member during relative movement between the ski stick handle body and the ski stick tube due to vibrations or the like, particularly when the tip of the ski stick slips.

To allow particularly simple actuation of the anchor members by the user without interrupting cross-country skiing, the design can be such that the anchor members rest in their first position on the movable top fixing member when the latter contacts the stationary top fixing member and rest on the stationary top fixing member only after relative movement has begun between the ski stick handle body and stationary top fixing member. In this design, the actuation of the anchor members is not complicated by the fact that they are in firm pressure engagement with the stationary top fixing member and, consequently, they can be rocked very easily from the first position into the second position and vice versa as they do not have to be pressed into pressure engagement with the stationary top fixing member even in the latter case.

In some cases, for example, when the cross-country skier has to make a steep ascent, particularly by herringbone stepping, it may be extremely desirable to disengage the spring action of the spring ski stick handle. Another embodiment of the invention is thus distinguished by a fixing device for holding the ski stick handle body relative to the ski stick tube.

A particularly preferred embodiment of this type is characterised in that the fixing device comprises an arresting member with a double wedge-shaped cross bar which is arranged on the ski stick handle body so as to be movable in the longitudinal direction thereof and which is in braking or arresting engagement with the ski stick tube or a brake lining provided on the latter in a first position whereas it releases the relative movement between the ski stick tube and ski stick handle body by means of a lifting wedge provided on the exterior of the ski stick handle body in a second position. This embodiment of the fixing device has the advantage, in particular, that the user can actuate it easily and rapidly using a thumb pushed without interrupting skiing.

The sprung ski stick according to the invention is suitable not only for cross-country skiing but also for ski roller training, and, in the latter case, the sprung ski stick according to the invention can be completed by a ski stick roller tip at the lower end of the ski stick tube, in which the bottom end portion of the ski stick tube is guided movably in the longitudinal direction thereof and is held by a stop device which is resiliently flexible under a predetermined pressure acting toward the tip end as well as by a restoring spring in an initial position from which it can be moved upon reaching the predetermined pressure toward the tip end sufficiently far to exert an impact on the ski roller tip. Sliding of the tip of the ski roller stick from the roller track is thus prevented or at least reduced as the impact exerted drives the tip slightly into the surface of the roller track.

The above advantages and features of the invention as well as additional ones are described in more detail below with reference to several particularly preferred embodiments which are illustrated in principle in the accompanying drawings.

BRIEF DESCRIPTION OF THE DRAWINGS

FIG. 1 is a longitudinal section through a sprung ski stick handle of a first embodiment according to the invention.

FIG. 2 is a plan view of the upper end of the ski stick handle shown in FIG. 1, FIG. 3 is an exploded perspective view of the individual parts of the ski stick handle shown in FIGS. 1 and 2 wherein some individual parts such as, the rubber or plastic cords and the ski stick handle body are illustrated in a shortened form or only partially, FIG. 4 is a longitudinal section through a sprung ski stick handle of a second embodiment according to the invention, FIG. 5 is a plan view of the upper end of the ski stick handle shown in FIG. 4, completed by a loop.

FIG. 6 is an exploded perspective view of the stationary upper fixing member and the anchor members of the ski stick handle shown in FIGS. 4 and 5, FIG. 7 is a perspective view of the movable upper fixing member and the lower fixing member of the ski stick handle shown in FIGS. 4 and 5, FIGS. 8 to 11 are three different embodiments of a fixing device for arresting the ski stick handle body relative to the ski stick tube.

DESCRIPTION OF PREFERRED EMBODIMENT OF THE INVENTION

Figure 12:
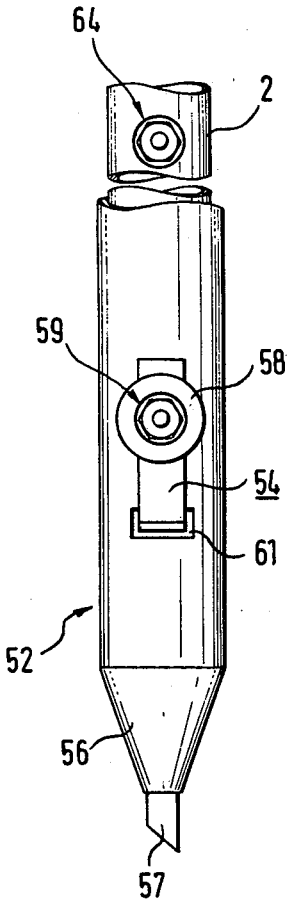
FIG. 12 is a side view of the ski stick tip, in particular a ski roller stick tip which can be used to complete the sprung ski stick.

FIGS. 1 to 3 show an embodiment of a sprung ski stick handle 1. This sprung ski stick handle 1 is illustrated together with a partially shown ski stick tube 2 forming the main body of a ski stick for use in particular in cross-country skiing. The sprung ski stick handle 1 is fixed on the top end 3 of the ski stick tube 2.

The principal parts of the spring ski stick handle 1 comprise one or more rubber or plastic cords 4 which are resiliently stretchable in the longitudinal direction and which are fixed, on the one hand, to a top fixing member 5 and, on the other hand, to a fixing member 6. A ski stick handle body 7 extends in its longitudinal direction between the top fixing member 5 and the bottom fixing member 6.

The top fixing member 5 is rigidly fixed to the top ski stick tube end 3 by means of a top ski stick handle fixing means which is described in more detail below, whereas the bottom fixing member 6 is fixed to the lower end of the ski stick handle body 7. The bottom fixing member 6 can be formed integrally with the ski stick handle body 7.

The top and bottom fixing members 5 and 6 respectively are preferably designed as caps comprising an annular portion 8 and a concentric tubular portion 9 which is integral with it as shown particularly clearly in FIG. 3. The annular portion 8 has holes 10 which are distributed uniformly over its periphery and which are equal in number to the strands of the rubber or plastic cords 4 running between the top and bottom fixing member 5 and 6. The holes 10 in the top and bottom fixing members 5 and 6 are aligned with each other in the longitudinal direction of the ski stick handle body 7 so that a strand of a rubber or plastic cord 4 runs between each hole 10 in the top fixing member 5 and the hole 10 in the bottom fixing member 6 which is aligned with it. These strands can be formed by a single continuous rubber or plastic cord 4, as shown in the view in FIG. 2, according to which the rubber or plastic cord 4 is guided back and forth threading between the top and bottom fixing member 5 and 6. Its two free ends, which are not shown in the drawing, are joined together firmly, for example, by knotting or applying a connecting member or in another suitable manner.

The external diameter of the annular portion 8 is equal to the external diameter of the ski stick handle body 7 which is preferably designed as a tube. The internal diameter of the annular portion 8 of the top fixing member 5 is smaller than the external diameter of the ski stick tube 2 so that it rests on the top end 3 of the ski stick tube, whereas the internal diameter of the annular portion 8 of the bottom fixing member 6 is somewhat larger than the external diameter of the ski stick tube 2. The internal diameter of the tubular portion 9 is slightly larger than the external diameter of the ski stick tube 2 so that this tubular portion 9 acts as a guide on the ski stick tube 2.

The ski stick handle fixing means provided at the top end of the ski stick handle 1 comprises, in addition to the top fixing member 5, a cylindrical component 12 which can be caused to expand inside the ski stick tube 2 by means of a screw 11 and whose external diameter in the non-expanded condition is approximately equal to the internal diameter of the ski stick tube 2; a disc 13 composed of rubber or elastomer, and a cone or dome body 14 consisting of rubber or an elastomer. These components are arranged in such a way that the top fixing member 5 is secured by means of the screw 11 between the top end 3 of the ski stick tube and the expandable component 12 on the one side and the disc 13 and the cone or dome body 14 on the other.

A loop (not shown) of the type which is conventional with ski sticks is fixed at the top end of the ski stick handle body 7.

The sprung ski stick handle 1 functions in the following manner; when the stick is in use, the strands of the rubber or plastic cords 4 are stretched when the ski stick handle body 7 is moved together with the bottom fixing member 6 in the direction of the arrows A. This energy is released again as the ski stick is lifted and can be used for propulsion. The sprung ski stick handle is particularly suitable for Nordic sports contests and also for ski roller training, giving in the latter case, in addition, a smoother stick action than would otherwise be obtained. The disc 13 composed of rubber material and the cone or dome body 14 also composed of such material produce a certain recoil absorption so as to dampen the striking of the ski stick handle body 7 on the top fixing member 5 as the ski stick handle body 7 moves backwards into its rest position shown in FIG. 1, in which it is held resiliently on the top fixing member 5 by the strands of the rubber or plastic cords.

Reference is now made to FIGS. 4 to 7 which show a sprung ski stick handle whose springiness can be adjusted.

This sprung ski stick handle 15 comprises as its principal components a top ski stick handle fixing means 16 which serves to fix the sprung ski stick handle 15 at the top end of the ski stick tube (not shown in FIG. 4) and on which the top ends of the strands of one or more rubber or plastic cords 17, 18 which stretch resiliently are fixed. This top ski stick handle fixing means 16 corresponds to the components 5 and 11 to 14 of the embodiment shown in FIGS. 1 to 3, which form the top ski stick handle fixing means in that arrangement. Moreover, the ski stick handle 15 has a bottom fixing member 16*a* on which the bottom ends of the strands of the rubber or plastics cords 17, 18 are fixed and which is arranged at the bottom end of a preferably tubular ski stick handle body 19 which, in turn, extends between the top ski stick handle fixing means 16 and the bottom fixing member 16*a* in its longitudinal direction.

Save for the fact that the bottom fixing member 16*a*, in contrast to the embodiment shown in FIGS. 1 to 3, externally surrounds, with its tubular portion 20, the ski stick handle body 19 at its bottom end and that by omitting the components 13 and 14, no recoil absorption takes place and the fixing of the ski stick handle 15 is effected by a transversely running screw 21 and a non-expandable cylindrical stud 22 which does not engage with the inside of the upper ski stick tube end 3, the essential structural alteration to the embodiment shown in FIGS. 1 to 3, which allows adjustment of the springiness involves the following:

Instead of the top fixing member 5 of the embodiment according to FIGS. 1 to 3, a fixing device is provided for the top ends of the strands of the rubber or plastic cords 17, 18 which is composed of a stationary top fixing member 23 arranged rigidly at the top end of the ski stick tube by means of the screw 21 and the stud 22 and of a movable top fixing member 24 arranged at the top end of the ski stick handle body 9 which can move together with the top end in the direction of the arrows A, i.e. in the longitudinal direction of the ski stick tube. The fixing device finally comprises parts designated as movable anchor members 25 which can be brought selectively into supporting engagement with the stationary top fixing member 23 or with the movable top fixing member 24 by a rotational movement about approximately 90°.

Holes 26 are provided in the stationary top fixing member 23 which are aligned in the longitudinal direction of the ski stick handle body 19 with corresponding holes 27 in the movable top fixing member 24 and in the bottom fixing member 20 which is designed identically to the movable top fixing member 24. A rubber or plastic cord 17 passes through each of the two holes 26 in the stationary top fixing member 23 and the holes 27 in alignment with it in the movable top fixing member 24 and the bottom fixing member 20, this cord thus forming two strands whose bottom ends are joined together to the exterior of the bottom fixing member 20 by means of clamping lugs 28 or in any other suitable manner. The strands of the rubber or plastic cords 17 are consequently fixed, on the one end on the stationary top fixing member 23 and on the other end on the bottom fixing member 20 and run in a slack manner through the holes 27 in the movable top fixing member 24.

These rubber or plastic cords therefore always act as elastic resistances during a movement of the unit consisting of the ski stick handle body 19 and the two fixing members 20 and 24 relative to the fixing member 23.

On the other hand, two other rubber cords 18 each pass through holes 29 in the movable anchor members 25, and the two strands of these cords 18 each extend through two holes 30 in the two fixing members 24 and 20 and are also joined together by clamping lugs 28 or in another suitable manner on the exterior of the bottom fixing member 20.

The holes 29 are provided in the longitudinal bars 36 or stems of the T-shaped anchor members 25, and these longitudinal bars pass together with the inserted rubber cord 18 into corresponding recesses 31 passing axially through the stationary top fixing member 23, each recess being aligned approximately with two holes 30 in each of the two fixing members 20 and 24. The upper outer edges of the fixing member 23 on both sides of the recesses 31 have elevations 32 which run obliquely toward the upper side of the fixing member 23. Bevels 33 which are complementary to these elevations 32 are provided on the outward pointing lower edges of the cross bar 34 of the T-shaped anchor members 25.

The ski stick handle 15 operates in the following manner;

When the anchor members 25 are located in the horizontal position shown in the drawing, i.e. their cross bars 34 lying next to the fixing member 23 as viewed in the longitudinal direction of the ski stick handle, they rest only on the movable top fixing member 24. If, as a result, the ski stick handle body 19 is moved together with the fixing members 20 and 24 in the direction of the arrows A, then the longitudinal bars 36 of the anchor members 25 move within the recesses 31 and, together with the movable fixing member 24 on which they are held by the tension of the rubber cords 18 in the direction of the arrows A. As the rubber or plastic cords 18 are not stretched during this movement, they are ineffective to a certain extent, and only the rubber or plastic cords 17 act in the manner of the rubber or plastic cords 4 described with reference to the embodiment according to FIGS. 1 to 3.

If, on the other hand, the anchor members 25 are rotated upwards about 90° from their position shown in the drawing so that their cross bars 34 are located above the fixing member 23, as viewed in the longitudinal direction of the ski stick handle, then the anchor members 25 are retained by the fixing member 23 when the unit composed of the ski stick handle body and the fixing members 20 and 24 is moved away from the fixing member 23 in the direction of the arrows A, since their cross bars rest on the upper side of the fixing member 23 on both sides of the recesses 31. The rubber or plastic cords 18 are consequently stretched and are therefore effective together with the rubber or plastics cords 17.

As shown by this mode of operation, the movable top fixing member 24 does not therefore serve directly for fixing the rubber or plastic cords but only for the selective indirect fixing of the rubber or plastic cords 18 by selective support of the anchor members 25 on its surface.

To allow the pivoting of the anchor members 25 from their vertical positions into their horizontal positions and vice versa to be effected as easily and quickly as possible by thumb pressure, without the user interrupting his skiing the longitudinal bars 36 are sufficiently long to rest initially, i.e. when the fixing member 24 lies against the underside of the fixing member 23, on the fixing member 24, even in the vertical position of the anchor members 25 and for the cross bars to run at a certain distance above the upper side of the fixing member 23 and for the bevels 33 not to engage with the elevations 32. As the lower ends of the longitudinal cross bars 36 are correspondingly flattened, a stable vertical position of the anchor member 25 is produced. If this support of the lower ends of the longitudinal cross bars 36 on the fixing member 24 is lowered as it is pulled downwards together with the ski stick handle body 19, the vertical position of the anchor members 25 is stabilised by engagement between the elevations 32 and the bevels 33 so that the anchor members 25 cannot rock out of the recesses 31 during this relative movement between the fixing member 25 and the unit composed of the ski handle body 19 and the fixing members 20 and 24.

It is pointed out that the cap-shaped fixing members 20 and 24 are arranged detachably or rigidly on the ski stick handle body 19, for example, by frictional contact, by positive locking or by other fixing means such as, for example, adhesion, bonding or the like.

The rubber or plastic cords 17, 18 are stretched slightly in the rest position of the ski stick handle, i.e. when the fixing member 24 engages with the fixing member 23, so that the engagement is maintained by the slight tension in the rubber cords. The same applies to the embodiment according to FIGS. 1 to 3 in which there is also a slight tension in the rubber or plastic cords 4 in the position shown in FIG. 1 in order to hold the ski stick handle body 7 in engagement with the top fixing member 5. The ski stick handle body 7 or 19 is therefore only movable from its rest position relative to the top fixing member 5 or 23 in one direction, and the total length of the ski stick is not changed. A loop 38 of conventional type, a portion of which is indicated in FIG. 5, is fixed on the ski stick handle body 19 and/or on the fixing member 24 so that it can move together with the ski stick handle member 19 in the direction of the arrows A relative to the fixing member 25 and the ski stick tube; for this movement in the direction of arrows A the fixing member 20 and 24 form guides as the diameter of their central holes 37 is only slightly larger than the external diameter of the ski stick tube.

FIGS. 8 to 11 show three different embodiments of a fixing device with which the user can arrest the ski stick handle body relative to the ski stick if, for any reason, he wishes all the rubber or plastic cords to be made ineffective and the ski stick to be usable as a normal ski stick with a fixed handle. According to the embodiment shown in FIG. 8, this fixing device consists of a belt 39 which is fixed on a ski stick handle body 19, optionally by means of the loop 38, and which has an eyelet or a hole (not shown in the drawing) with which it can be engaged by a bolt 40 rigidly provided on the stationary upper fixing member 23, the eyelet or the hole being arranged in such a way that the belt 39 is stretched taut while it is engaged with the bolt 40. If the belt 39 is to be released from the bolt 40, this can be effected in a simple manner by thumb pressure.

The fixing device according to FIGS. 9 and 10 consists of a catch 41 which is fixed at the free end of a belt 42 whose other end is fixed to the ski stick handle body 19. This catch 41 has a handle portion 43 and a stud 44 which can be inserted into a suitable hole (not shown in the drawing) in the stationary top fixing member 23 and is thickened somewhat at its lower end so that it can snap elastically into the lower end of this hole which is somewhat widened accordingly, in which state the belt 42 is stretched taut.

FIG. 11 shows an embodiment of a fixing device which can be called a double wedge brake, having a substantially T-shaped arresting member 45 whose cross bar extends in the axial direction of the ski stick tube 2 and has a front wedge-shaped portion 46 and a rear wedge-shaped portion 47. The longitudinal bar or stem 48 of the T-shape arresting member 45 acts as an actuating handle and projects through a slot 49 in the ski stick handle body 7 in the axial direction of the ski stick. The arresting member can be displaced along the slot 49 regardless of the point at which the stem 48 forming the actuating handle penetrates through the slot 49. The handle is always wider than the slot 49. In its upper end position the arresting member 45 engages a brake lining 50 fixed on the ski stick tube 2, for example, by adhesion, so that the ski stick handle body 7 is arrested on the ski stick tube 2. In its lower position, the bar 48 runs on to a U-shaped lifting wedge 15 fixed on the external side of the lower end of the slot 49 by adhesion or in another suitable manner, so that the arresting member 45 is held in the lower position. As the arresting of the ski stick handle body 7 on the ski stick tube 2 takes place in the upper position thereof and this ski stick handle body 7 can only be moved downwards from this position relative to the ski stick tube 2, based on FIG. 11, the arresting member 45 cannot engage the brake lining 50 during this movement if it is located in its lower position, but rather it is necessary for this purpose to push the arresting member 45 by thumb pressure along the slot 49 into its upper end position when the ski stick handle body 7 is located in its uppermost position, as illustrated in FIG. 1. At the lower end of slot 19 there is provided a U-shaped retaining bracket 51 receiving the arresting member 45 in its non-operative position. The braking action of the brake lining 50 can be influenced by suitable choice of the material thereof or by roughening. The brake lining 50 can optionally also be dispensed with due to the wedge-shaped portions 46 and 47, so that the arresting member 45 engages directly with the ski stick tube 2, in which case its surface is preferably roughened at the point of engagement.

The various embodiments of the fixing devices can obviously be used both in the design of the ski stick handle according to FIGS. 1 to 3 and in the design according to FIGS. 4 to 7.

Figure 13:
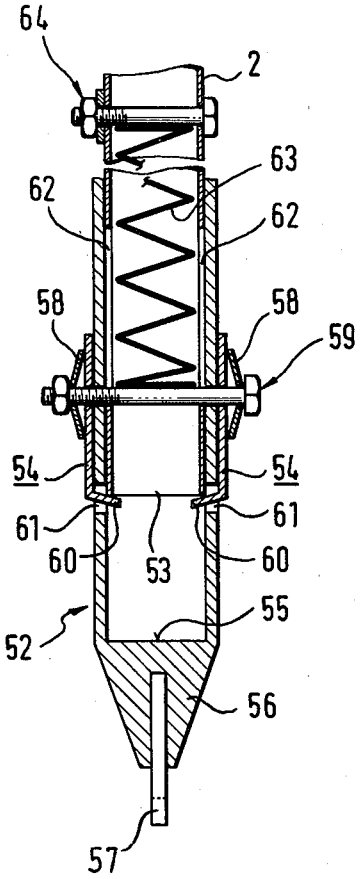
FIG. 13 shows a longitudinal section through the ski stick tip shown in FIG. 12.

The spring force with which the ski stick handle body 7 or 19 is pulled downwards relative to the top end of the ski stick during use of the stick, can also be utilised to give the ski stick tip a blow by means of which the slipping of the ski stick tip on the rolling track in the case of a roller ski stick is avoided or at least reduced. An embodiment of this type is shown in FIGS. 12 and 13 and is basically such that the ski stick tube 2 is mounted movably or telescopically in the roller ski stick tip 52 and rests with its lower end 53 on an arresting device comprising, for example, holding brackets 54. This arresting device is designed in such a way that, during a predetermined downward directed pressure, it releases the lower end 53 of the ski stick tube 2 which, in turn, can be moved sufficiently far for this lower end 53 to strike the interior 55 of the ski roller stick tip head 56. This blow propels the pointed end 57, which consists of, for example, a pointed hard metal pin and is inserted firmly into the roller ski stick tip head 56, into the surface of the rolling track and thus prevents slipping of the ski stick roller tip.

In particular, the holding brackets 54 are approximately L-shaped in design and are fixed diametrally on the exterior of the roller ski stick tip 52 by means of Belleville washers and a nut and bolt arrangement 59 in such a way that each cross bar 60 of the L-shape which runs somewhat obliquely downwards projects through a lateral slot 61 into the internal cylindrical space of the roller ski stick top 52 whose lateral walls act as a guide for the lower end portion of the ski stick tube 2. If the bottom end 53 of the ski stick tube 2 is pressed on to the cross bars 60 with a predetermined force, the cross bars 60 are pressed outwards against the force of the Belleville washers 58, and the ski stick tube 2 which has a through slot 62 in the region of the through bolt of the nut and bolt arrangement 59 can move downwards and strike the interior base 55. A helical spring 63 is provided to return the ski stick tube 2 to its upper end position. The helical spring 63 acts between the through bolt of the nut and bolt arrangement 59 and the bolt of another nut and bolt arrangement 64 provided in the ski stick tube 2. The upper end position of the ski stick tube 2 relative to the roller ski stick tip 52 is fixed by the lower end of the slot 62 which comes to rest on the bolt of the nut and bolt arrangement 59.

What is claimed is:

1. A ski stick comprising a ski stick tube; a sprung ski stick handle having a handle body and top handle fixing means, said top handle fixing means being at least in part fixed on the top end of the ski stick tube, said handle body being displaceable with respect to the ski stick tube; and spring means arranged between the ski stick handle body and the ski stick tube which comprises resiliently stretchable cords which run through the ski stick handle body from the top handle fixing means toward the bottom end of the ski stick handle body and are joined to the ski stick handle body at the bottom end thereof.

2. A ski stick according to claim 1, wherein the resiliently stretchable cords are composed of rubber.

3. A ski stick according to claim 1, wherein the resiliently stretchable cords are composed of plastic material.

4. A ski stick according to claim 1 further comprising a recoil damper formed by an elastic disc and an elastic conical or domed body, and wherein said top handle fixing means comprise a top fixing member which rests on said top end of the ski stick tube and on which the cords are arranged, and an expandable component and a screw which causes the expandable component to expand inside the ski stick tube and by means of which the top fixing member and recoil damper are fixed in position.

5. A ski stick according to claim 1 further comprising one or more anchor members and wherein the top fixing means comprise a stationary top fixing member fixed to the top end of said ski stick tube and a movable top fixing member some of the cords being secured to the stationary top fixing member and some of the cords being secured to the respective anchor members, said anchor members being selectively movable into a first position in which they rest on the stationary top fixing member and into a second position in which they rest on the movable top fixing member and are entrained thereby.

6. A ski stick according to claim 5, wherein the anchoring members are substantially T-shaped, the cords secured to said anchor members being fixed to the longitudinal stem portions thereof, and wherein the stationary top fixing member has one or more recesses therein which extend in the longitudinal direction of the ski stick receiving the longitudinal stem portions together with the cords fixed thereto the cross bars of the anchor members being pivotal between a first position in which they are located above the stationary top fixing member and a second position in which they are located laterally adjacent the stationary top fixing member.

7. A ski stick according to claim 6, wherein the cross bars project laterally beyond the periphery of the ski stick handle body.

8. A ski stick according to claim 6, wherein the anchor members rest on the movable top fixing member in the first position when the latter is at rest and rest on the stationary top fixing member only once the relative movement between the ski stick handle body and the stationary top fixing member has begun.

9. A ski stick according to claim 5, wherein the edge of the stationary top fixing member has a projection on one or both sides, which projection runs obliquely toward the upper surface of the stationary top fixing member and wherein the edge of the associated cross bar facing the projection in the first position of the switches has a complementary bevel.

10. A ski stick according to claim 1, including brake means for arresting the movement of the ski stick handle body relative to the ski stick tube.

11. A ski stick according to claim 10 wherein the brake means comprises an arresting member which is arranged on the ski stick handle body so as to be movable in the longitudinal direction thereof, said arresting member having a double wedge-shaped cross bar which is adapted to simultaneously releasably engage the ski stick tube and ski stick handle body, and a gripping member extending through a slot in ski stick handle body for manipulation thereof.

12. A ski stick according to claim 11, including a brake lining member provided on the ski stick tube for coaction with said arresting member.

13. A ski stick according to claim 1, 5 or 10 further comprising a ski stick tip at the bottom end of the ski stick tube in which the bottom end portion of the ski stick tube is movably guided in its longitudinal direction, a stop device which is resiliently flexible at a predetermined pressure holding said ski stick tube and being moved upon reaching said predetermined pressure sufficiently far to permit the ski stick tube to impact on the ski stick tip against the force of a restoring spring positioned between the ski stick tube and the ski stick tip.

* * * * *